United States Patent [19]

Emmel

[11] Patent Number: 4,550,889

[45] Date of Patent: Nov. 5, 1985

[54] TRAFFIC CONTROL SYSTEM FOR SINGLE TRACK RAILROAD

[75] Inventor: David G. Emmel, Upper St. Clair Township, Allegheny County, Pa.

[73] Assignee: American Standard Inc., Pittsburgh, Pa.

[21] Appl. No.: 397,383

[22] Filed: Jul. 12, 1982

[51] Int. Cl.[4] ..... B61L 21/00

[52] U.S. Cl. ..... 246/28 R; 246/3; 246/26

[58] Field of Search ..... 246/2 E, 26, 34 A, 198, 246/250, 298, 122 R, 3, 28 R; 340/935

[56] References Cited

U.S. PATENT DOCUMENTS

| | | | |
|---|---|---|---|
| Re. 22,780 | 8/1946 | Van Horn | 246/3 |
| 2,318,545 | 11/1941 | Van Horn | 246/3 |
| 2,420,579 | 5/1947 | Young | 246/3 |
| 2,510,324 | 6/1950 | Talbert | 246/3 |
| 2,520,858 | 8/1950 | Shields | 246/33 |
| 2,647,987 | 8/1953 | Failor | 246/3 |
| 2,785,295 | 3/1957 | Hursh | 246/26 |
| 2,819,388 | 1/1958 | Pelikan | 246/3 |
| 2,854,566 | 9/1958 | Ihrig | 246/26 |
| 2,976,403 | 3/1961 | Reustle | 246/26 |
| 3,008,041 | 11/1961 | Smith | 246/26 |
| 4,323,210 | 4/1982 | Elder | 246/26 |

*Primary Examiner*—John W. Caldwell, Sr.

*Assistant Examiner*—Michael F. Heim

*Attorney, Agent, or Firm*—A. G. Williamson, Jr.

[57] ABSTRACT

Reversal of the established traffic direction is initiated by a request for an entering train movement at the existing exit end of the single track stretch. This deenergizes the adjacent traffic line circuit section in the new direction. Line circuit deenergization cascades section by section through the stretch to the other end. At each location, the active traffic direction register relay is deenergized but the magnetic stick traffic relay holds in its established traffic position. At the new exit end, reception of the deenergization signal reverses positions of the traffic and direction register relays if the new approach track circuit is clear. This initiates the transmission of line circuit energy in the opposite direction. At each intermediate location, reception of this opposite direction line energy energizes the other direction register relay if the approach track circuit is clear. This positions the traffic relay for the reversed traffic direction to transmit line energy through the approach traffic line circuit. Application of line energy in the new direction cascades and, when received at the new entrance end, traffic end direction register relays position to establish the new traffic direction and authorize the train movement. Such action assures that all traffic relays are properly positioned and that the stretch is clear of trains.

8 Claims, 3 Drawing Figures

TRAFFIC CONTROL SYSTEM FOR SINGLE TRACK RAILROAD

FIELD OF THE INVENTION

My invention pertains to a traffic control system for a stretch of single track railroad. More specifically, the invention relates to a two-wire traffic line circuit arrangement for a railroad signal system which uses vital magnetic stick traffic relays whose positions are checked through the stretch to establish traffic direction and which eliminates use of block directional stick relays.

BACKGROUND OF THE INVENTION

Line circuits are frequently used to control traffic direction in a stretch of railroad track where trains move in either direction between stations. Such traffic circuits are especially used where either direction running is used on each track of a double or multi-track railroad between adjacent crossover interlockings. Operation of such traffic circuits must, of couse, be vital to assure that, at any time, only one direction of traffic can be established and, if used that cab signal or train control energy can be supplied in the rails for only one direction of travel. That is, it must be impossible to supply cab signal energy to the rails at one time which would authorize opposing train moves. At the same time, the traffic circuits must be economical in the line wire and relay apparatus required. Such saving in line wire is particularly pertinent where remote controlled electric switch locks are employed on spur tracks between signal locations to protect against inadvertent and unauthorized entry of a train onto the main track. A desirable goal is to also eliminate block directional stick relays at each intermediate location, between the end interlockings, where the detector track circuits are divided or repeated. In other words, it is desirable to establish and hold traffic direction at each intermediate location by the use of a single traffic relay of the so-called polar or magnetic stick type.

Accordingly, an object of my invention is an improved and more economical traffic control circuit for a signal system for a stretch of single track railroad.

Another ojbect of the invention is a two-wire traffic line circuit arrangement for a single track railroad signal system which uses only a single vital magnetic stick relay at each location to establish and hold the selected traffic direction.

A further object of my invention is a traffic control system for a single track stretch of railroad in which a single vital magnetic stick relay at each end and intermediate location establishes and holds the selected traffic direction.

Yet another object of the invention is a reversible traffic line circuit arrangement, for a signal system for a single track stretch of railroad which is divided into a plurality of detector track circuits, each with a corresponding separate reversible traffic line circuit section selectively energized from the desired exit end of the section to energize a direction repeater relay at the entrance end, each location also including a single magnetic stick traffic relay positioned in accordance with the condition of the associated repeater relays to establish and hold the selected traffic direction until a positive action is taken to reverse the traffic direction.

Other objects, features, and advantages of my invention will become apparent from the following specification and appended claims when taken in connection with the accompanying drawings.

SUMMARY OF THE INVENTION

In the arrangement of the invention, a reversible, two-wire traffic line circuit corresponds to and extends along each section of the stretch of single track, with each section having a reversible detector track circuit shown as being of the coded type. At each intermediate location, i.e., the track circuit junctions between the end locations, each terminating traffic circuit section is selectively controlled by the single vital, magnetic stick traffic relay. In particular, the line circuit section corresponding to the approach track section in the established traffic direction is energized from that location. Conversely, a separate direction register or repeater relay is connected across the line circuit in the departure direction, i.e., the advance section. Energization of a particular line circuit is enabled by the response of the other direction register relay to energy received from the next advance location and is completed by the traffic relay positioned for the established direction. The traffic relay is positioned in accordance with the response of the two register relays, i.e., one energized, the other deenergized, and holds in the established position if deenergized. At the stations at each end of the stretch, the terminating line circuit section is energized, when established traffic exits at that end, over contacts of the vital traffic relay positioned for exiting traffic direction and contacts of a repeater relay which check the safe conditions of the local interlocking routes. When an end station is the established entrance into the stretch, a second traffic repeater relay is connected to the line circuit to receive energy from the adjacent intermediate location. This repeater relay completes a circuit, which also checks the entrance position of the traffic relay, to enable the clearing of an entrance signal if advance track and route lock conditions are proper.

To reverse traffic direction, a route is requested at the established exit through that end station interlocking into the single track stretch. This releases the approach traffic repeater relay to deenergize the traffic line circuit to the first intermediate location. The end station traffic relay holds its existing traffic position even though deenergized. At the first intermediate location, the direction register relay for the established traffic releases due to the deenergized line circuit from the adjacent end location. This opens and thus deenergizes the traffic line section to the next location. Line circuit deenergization cascades through the intermediate locations to the other end station where the entering traffic repeater relay releases. If the adjacent track circuit is registering a clear, i.e., unoccupied, secton and no signal or routes have been authorized, the other direction registry relay is energized and picks up to enable the energization of the traffic circuit. The shift in repeater or registry relay conditions repositions the vital traffic relay to the reverse traffic position. This energizes the line circuit and also reverses the track circuit direction to match the new traffic direction. At each intermediate location, if the approach track circuit in the new direction registers clear, the new direction repeater relay is energized by the newly received line circuit energy. This shift in conditions of the two direction repeaters repositions the local traffic relay for the newly desired traffic direction. This applies energy to the line circuit to the approach location and reverses the track circuit connections. At the new entrance end, the reception of line circuit energy actuates the other direction repeater relay which completes a circuit to reposition the traffic relay. This completes the traffic reversal process. With the traffic relay positioned and the corresponding direction repeater energized, an interlocking traffic relay for the first section is actuated to enable the clearing of a signal, other route and track conditions being safe, to authorize a train to move in the newly established direction.

If a remote electric switch lock is included in the stretch, control can be exercised from a single adjacent intermediate location using only four extra line wires. When a switch lock release is requested for entry of a train from the controlled spur track onto the main track, a normal switch conditions repeater relay at the intermediate location, controlled over a pair of line wires, is released. This in turn releases a control relay which interrupts the end to end continuity of the traffic line circuits by connecting both direction repeater relays across the corresponding traffic circuit sections. With the line circuit network thus interrupted, the established entrance end location shifts to reverse traffic direction in the same manner as with a requested reversal. This cascades toward the lock control location so that both direction repeater relays are eventually picked up. This transmits a control over the other pair of line wires which actuates the switch lock magnet to release the mechanical lock of the switch. Since the track circuits are also reversed to feed from each end to the control location, the train entering the main track can move in either direction under signal protection.

BRIEF DESCRIPTION OF THE DRAWINGS

Before defining the invention in the claims, I shall describe a specific system arrangement as illustrated in the accompaying drawings, in which:

Figure 1A:
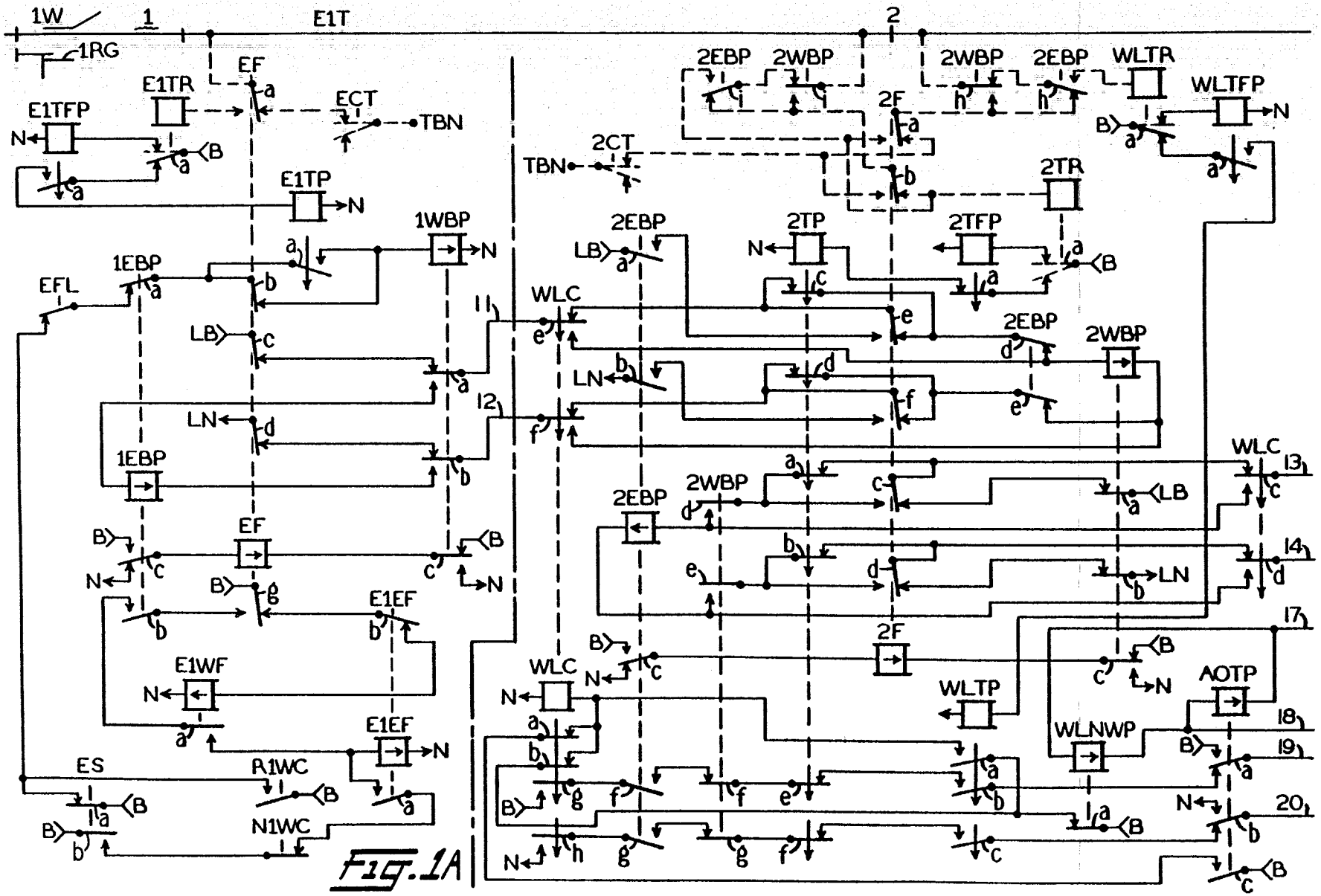
FIGS. 1A, 1B, and 1C, when placed adjacent left to right in that order, illustrate, in schematic circuit diagram form, a traffic control system for a stretch of single track railroad embodying my invention.

At each of the several separate locations along the stretch, a source of local direct current (DC) energy for operating relays and similar devices is provided. Since any one of several well known types may be used, a specific source is not shown and only connections to the positive and negative terminals are shown by the conventional references B and N, respectively. At each location, a DC source of line circuit energy is also provided but, for similar reasons, only the terminal connections are designated by the references LB and LN. Since all track circuit connections are shown in a conventional single line manner by dash lines, the separate track circuit energy source is designated by the single reference TBN. Relay windings are designated by conventional symbols and associated contacts operated thereby are normally shown in vertical alignment above or below the control winding. Contacts controlled by each relay are designated by different lower case letter references. However, for convenience and to simplify the circuit diagrams, some relay contacts are not aligned with the control winding. In such cases, the relay reference character is repeated directly above such separated contacts in addition to the distinct contact reference. For most of the relays, the movable armature portion of each relay contact is shown horizontally and moves upward to close front contact circuits when the relay winding is energized. When the relay winding is deenergized, contact armatures occupy the lower position to close back contact circuits. Slow release relays, which hold front contacts closed for a preselected time period after the winding is deenergized, are designated by downward pointing arrows drawn through each associated contact armature.

Some of the relays with horizontal armatures, e.g., relay 1EBP (FIG. 1A), are of the biased type, designated by an arrow within the winding symbol, in which armatures respond to close front contacts only when energizing current flows in the direction designated by the arrow. The traffic relay F at each direction is of the vital, magnetic stick type. Such relays are distinguished by showing the contact armatures in the vertical position. These relays respond to energizing current flowing in the direction of the arrow within the winding symbol to move armatures to the left to close normal contacts. Current in the opposite direction causes the armatures to move to the right to close reverse contacts. When deenergized, such relays hold their contacts in the position to which last operated. A few contacts are illustrated without control windings. Their operation will be explained when pertinent in the description.

DETAILED DESCRIPTION OF THE ILLUSTRATED EMBODIMENT

Referring to the drawings, FIGS. 1A, B, C, when assembled left to right in that order, illustrate a traffic control system for a stretch of railroad track, shown across the top by conventional single line symbol, over which trains move in either direction under control of the traffic and signal system. The left to right direction is herein termed eastbound (EB), the opposite, westbound (WB). The stretch is divided into sections by insulated joints, also conventionally indicated. At each end there is a short interlocking section, designated locations 1 and 5, each with at least one track switch 1W and 5W, respectively. The switches represent turnouts to one or more other track stretches which may extend parallel to that shown. Intermediate locations are designated 2, 3, and 4, with 2 and 4 being junctions between sections and location 3 being that of a remote switch lock mechanism WL, to be discussed later, securing a spur track. Trains move into and through the stretch under direction of signal indications displayed by entering signals 1RG and 5LG, shown conventionally, for eastbound and westbound trains, respectively.

Figure 1B:
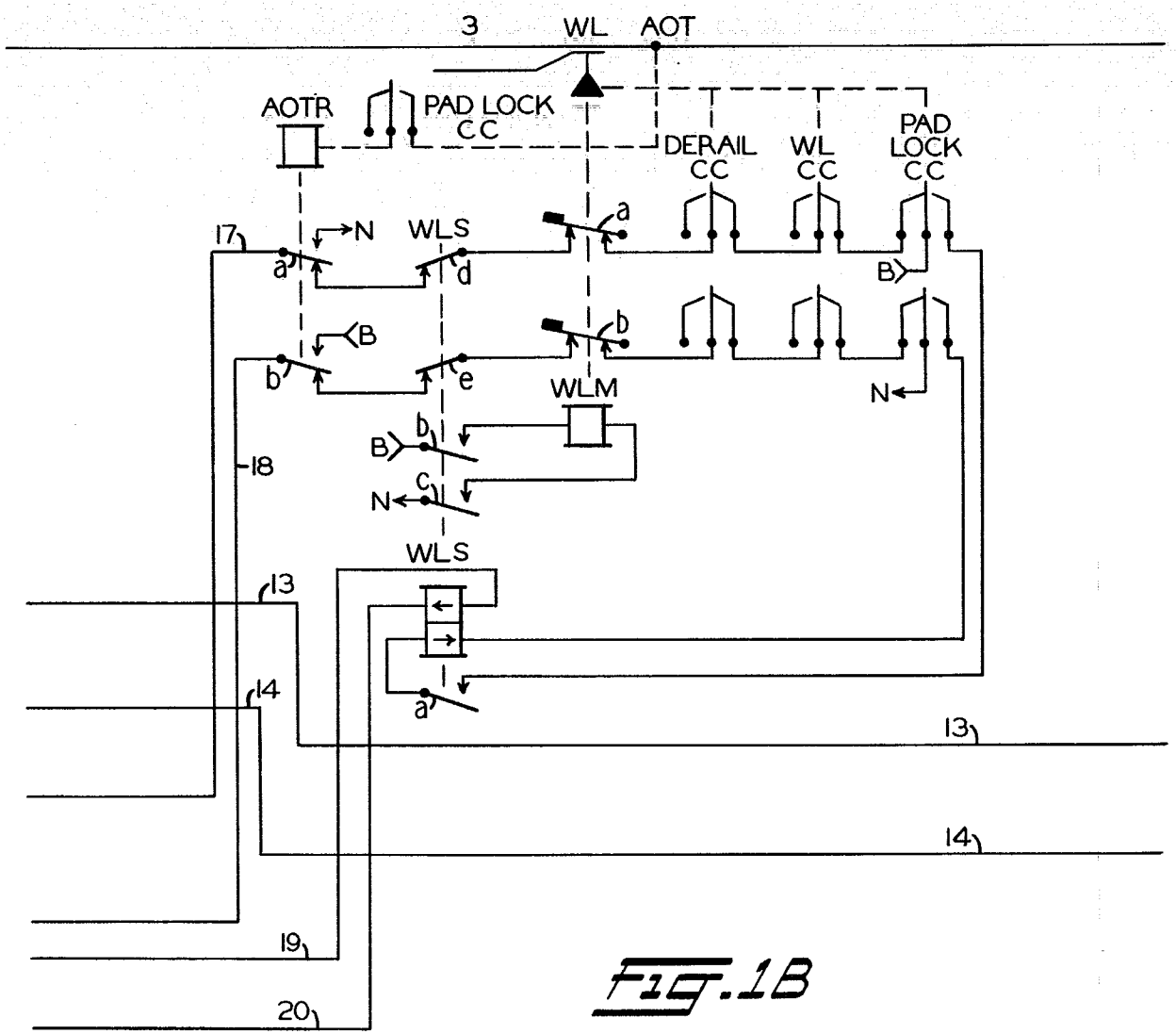
Figure 1C:
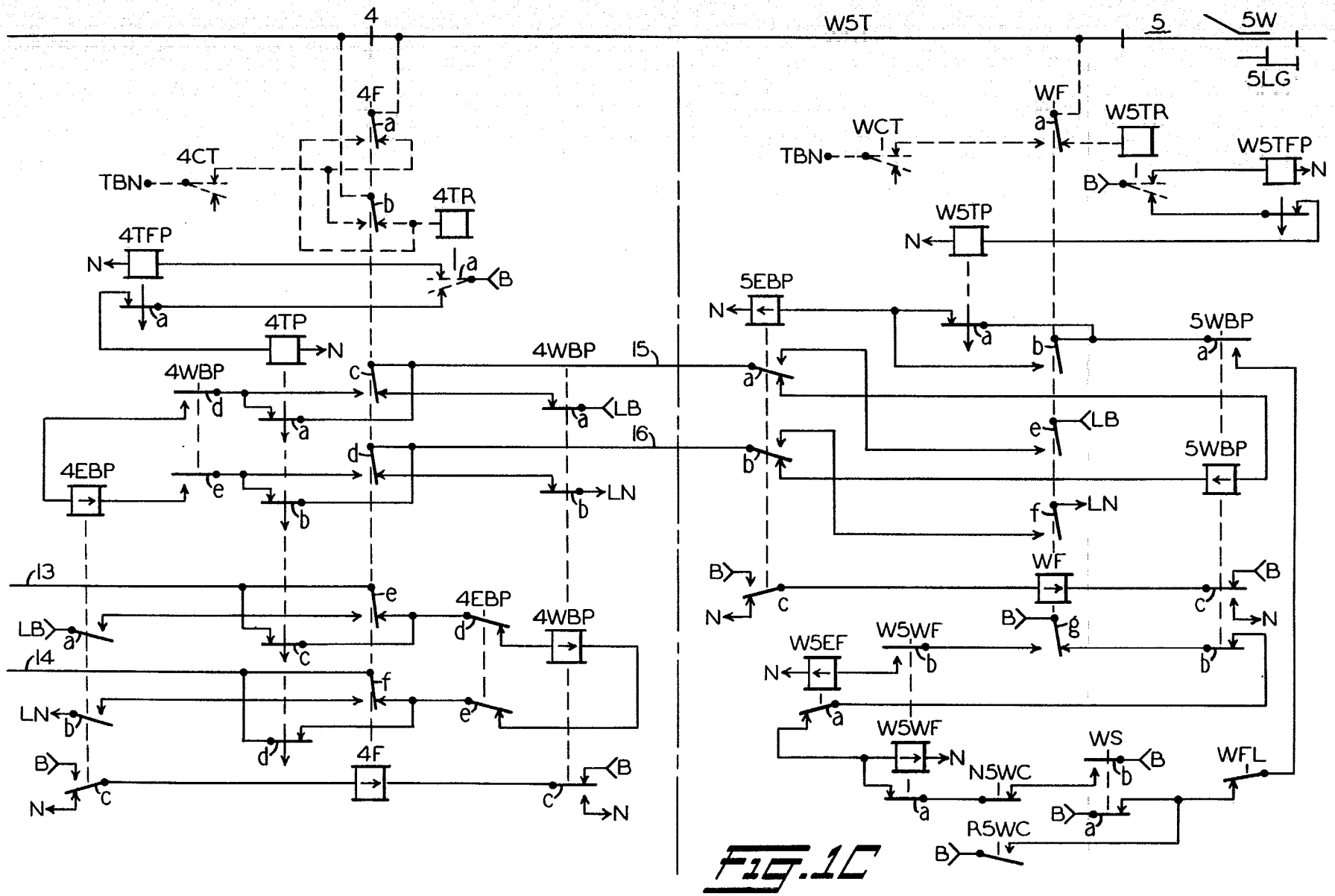

The stretch is provided with track circuits for train detection, section by section, each circuit being reversible in accordance with established traffic direction. The track circuits are illustrated as being of the coded type but other forms may be used and cab signal control energy is assumed to be supplied. The wayside track circuit rail connected networks, for simplicity, are shown conventionally using single dashed line and single relay contacts. Since such track circuits are well known and generally understood, operation will be only briefly explained. For example, at location 4 on FIG. 1C, with westbound traffic established, the code following track relay 4TR is connected to the rails to the left of the insulated joints, i.e., section 2-4, over reverse contact b of the vital, magnetic stick traffic relay 4F to receive coded track energy from the next advance location 2. The code transmitting contacts 4CT periodically connect the track energy source TBN to the rails to the right of the insulated joints over reverse contact a of relay 4F to transmit coded track energy through section W5T to the end location or station 5. Selection of the specific code rates is not involved and is thus not shown or included. Reception of coded energy is detected or decoded by a front-back repeater network including repeater relays 4TFP and 4TP, each having slow release characteristics. Relay 4TFP is periodically energized from the local DC source (B, N) over front contact a of relay 4TR. Once picked up, front contact a is held closed during the code following operation by the relay's slow release. With contact a of relay 4TFP closed, relay 4TP is periodically energized, over back contact a of relay 4TR, and picks up to hold its front contacts closed, as long as relay 4TR follows code, to register or indicate an unoccupied track section. When EB traffic is established, the rail connections of relay 4TR and contacts 4CT are reversed.

An equivalent arrangement exists at location 2 as long as back contacts h and i of either relay 2WBP or 2EBP are closed. With WB traffic, track relay 2TR follows code received from the west end station 1 and contacts 2CT transmit east. Relays 2TFP and 2TP decode and register the occupancy condition of the west section E1T. When traffic relay 2F positions normal, the rail connections and operation are reversed. If both relays 2WBP and 2EBP are picked up for switch lock release, as will later be discussed, relay 2TR is connected to the west track section, over front contacts i, in series, of these relays. A supplemental track relay WLTR is then connected to the east section over front contacts h of relays 2EBP and 2WBP to receive coded energy from location 4. Under these conditions, repeater relays WLTFP and WLTP decode the operation of relay WLTR. Since this is not normal operation, relay WLTR and its repeaters are shown released.

At the east end location 5, with WB traffic, track relay W5TR is connected to the rails of west section W5T, over reverse contact a of traffic relay WF, so that it follows code from contacts 4CT. Repeater relays W5TFP and W5TP pick up to register the unoccupied condition of section W5T. With EB traffic, contacts WCT are connected to transmit code through section W5T. At the west end location 1, contacts ECT are connected over reverse contact a of traffic relay EF to transmit code through the rails of section E1T. When traffic is reversed, track relay E1TR is connected over normal contact a of relay EF to receive code from location 2 and its repeater relays E1TFP and E1TP function to register the occupancy condition of section E1T.

The system is illustrated in the condition with westbound traffic established and all traffic relays F positioned reverse. It is assumed that no trains are in the stretch so that the sections are unoccupied, each track relay TR is following code from the adjacent location west, and its repeater relays TFP and TP are picked up. At location 2, switch lock control relay WLC is energized by a stick circuit including its own front contact b and front contact a of switch lock normal repeater relay WLNWP. Line circuit energy is thus fed from west to east, cascading through each intermediate location. At the west end station 1, line circuit energy from terminals LB and LN is applied over reverse contacts c and d of relay EF and front contact a and b of relay 1WBP to line wires 11 and 12. This latter relay is energized over a circuit including reverse contact b of relay EF to check that WB traffic is established, back contact a of relay 1EBP which checks that no line circuit energy is being received, a back contact EFL which indicates no eastward route is requested through station 1, and a front contact a of route lock relay ES associated with the station 1 interlocking controls.

At location 2, the energy on lines 11 and 12 is applied over front contacts e and f or relay WLC, front contacts c and d of relay 2TP in parallel with reverse contacts e and f, respectively, or relay 2F, and back contacts d and e of eastbound direction repeater relay 2EBP to the winding of westbound direction repeater relay 2WBP. The polarity of the line circuit energy is proper for this biased relay to pick up. Since relay 2EBP is deenergized by open back contacts d and e of relay 2WBP, traffic relay 2F is held reverse by the circuit including front contact c of relay 2WBP and back contact c of relay 2EBP.

Energy is applied to traffic line circuit wires 13 and 14 from terminals LB and LN at location 2 over front contacts a and b or relay 2WBP, reverse contacts c and d of relay 2F, and front contact c and d of relay WLC. These line wires bypass location 3 (FIG. 1B) and at location 4 the energy is applied, with proper polarity, to westbound direction repeater relay 4WBP over front contacts c and d of relay 4TP, in parallel with reverse contacts e and f, respectively, of traffic relay 4F, and back contacts d and e of relay 4EBP. This last direction repeater relay is deenergized because back contacts d and e of relay 4WBP are open. With front contact c of relay 4WBP and back contact c of relay 4EBP both closed, relay 4F is held in its reverse position.

The final traffic line circuit section, between locations 4 and 5, is energized at location 4 from terminals LB and LN at front contacts a and b, respectively, of relay 4WBP over reverse contacts c and d of relay 4F. This energy is carried over line wires 15 and 16 and back contacts a and b of relay 5EBP to the winding of westbound direction repeater relay 5WBP, with proper polarity for this biased relay. With back contact a of relay 5WBP open, the opposite direction registry relay 5EBP is obviously deenergized. Traffic relay WF is held in its reverse position. With normal contact g of relay WF open, the section W5T east traffic relay W5EF is deenergized. At the same time, the associated west traffic relay W5WF is energized by the circuit including reverse contact g of relay WF, front contact b of relay 5WBP, and back contact a of relay W5EF. With relay W5WF picked up, the control network for clearing westbound departure signal 5LG is enabled. Relay W5WF is at times held energized by a stick circuit over its own front contact a, a switch 5W normal correspondence contact N5WC, and back contact b of route lock relay WS when a westward route is cleared. It is to be noted that back contact b of relay W5WF also interrupts the circuit for relay W5EF to prevent this relay from being energized should an improperly positioned relay inadvertently be substituted for relay WF.

It is now assumed that the traffic is to be changed to the EB direction. The operator requests an eastward route at location 1 through the interlocking, over switch 1W, to exit into section E1T. Completion of the route causes the east traffic lock contact EFL to open in the previously traced circuit for relay 1WBP, which then releases. Opening of front contacts a and b of relay 1WBP interrupts the supply of energy to line wires 11 and 12 so that, at location 2, relay 2WBP is deenergized and releases. The opening of its front contacts a and b deenergizes line wires 13 and 14 and, at location 4, relay 4WBP releases. Correspondingly, front contacts a and b of relay 4WBP open, removing energy from line wires 15 and 16, and relay 5WBP at the east end station releases. Thus the deenergization of the line circuit at location 1 has cascaded to the other end of the stretch. It is to be noted that, at each location, the opening of front contact c of the WBP relay deenergizes the traffic relay F. However, these relays hold in their reverse positions.

The closing of back contact a of relay 5WBP completes the circuit for relay 5EBP, assuming section W5T clear so that front contact a of relay W5TP is closed and no route traffic lock in force, i.e., contact a of relay WS and contact WFL closed. Thus energized, relay 5EBP picks up to register the request for EB traffic. Since back contact c of relay 5WBP and front contact c of relay 5EBP are now closed, the energy applied to relay WF shifts this relay to its normal position. Energy is now fed westward in traffic line circuit 15, 16 over normal contacts e and f of relay WF and front contacts a and b of relay 5EBP. It is also noted that contact a of relay WF now connects code transmitter contacts WCT to the rails of section W5T to feed coded track energy westward to location 4. Since relay W5TR is disconnected, it remains released, which is followed shortly by the release of relays W5TFP and W5TP. However, normal contact b of relay WF now bypasses front contact a of relay W5TP to hold relay 5EBP energized.

At location 4, with relay 4WBP released and relay 4TP picked up to register the west track section clear, relay 4EBP receives the line energy transmitted on wires 15 and 16 from the east end station. When front contact c of relay 4EBP closes, traffic relay 4F is positioned normal to establish EB traffic. With front contacts a and b of relay 4EBP closed, line circuit energy is applied to wires 13 and 14 over normal contacts e and f of relay 4F. Also, contacts a and b of this traffic relay shift the track circuit apparatus connections so that contacts 4CT now transmit coded track energy from source TBN westward and relay 4TR responds to coded track energy in section W5T from station 5. The code following operation of relay 4TR may be briefly interrupted during this shift but the slow release times of its repeaters should bridge the interruption. In any event, normal contacts c and d of relay 4F bypass front contacts a and b of relay 4TP prior to this instant so that there is no release of relay 4EBP and no interruption of line circuit energy being transmitted westward.

At location 2, ignoring relay WLC which is held energized, the energy received on wires 13 and 14 is applied over front contacts a and b of relay 2TP, which checks the west track (E1T) clear, and back contacts d and e of relay 2WBP, i.e., no WB direction registered, to relay 2EBP which picks up to register EB traffic direction. The closing of front contact c of this register relay reenergizes relay 2F with opposite polarity and it operates normal to set up EB traffic. Line energy from terminals LB and LN at front contacts a and b, respectively, or relay 2EBP is now applied over normal contacts e and f of relay 2F to line wires 11 and 12 extending west to end station 1. Contacts a and b of relay 2F shift the track circuit connections of relay 2TR and transmitter contacts 2CT. It is noted that back contact h of relay 2WBP now connects relay 2TR to the rails and bypasses relay WLTR. Also, contacts 2CT are connected to the rails of section E1T over back contact i of relay 2WBP.

Energy on wires 11 and 12 received at west end location 1 energizes relay 1EBP over back contacts a and b of relay 1WBP. The pick up of direction register relay 1EBP verifies that relays F at all other locations are positioned normal for EB traffic and that all track circuits are clear or unoccupied. The closing of front contact c of relay 1EBP now positions relay EF normal to complete the establishment of the desired EB traffic direction. Contact a of relay EF shifts the track circuit connections so that relay E1TR receives track code from location 2. Relays E1TFP and E1TP shortly pick up and front contact a of the latter relay closes. However, previously opened back contact a of relay 1EBP holds relay 1WBP deenergized. The opening of reverse contact g of relay EF deenergizes relay E1WF. With normal contact g of relay EF and front contact b of relay 1EBP closed, the closing of back contact a of relay E1WF energizes relay E1EF. The pick up of this relay enables the control circuitry for signal 1RG so that all other conditions being safe, it can display a proceed indication for an EB train to move into the track stretch. With switch 1W normal, the closing of back contact b of a route lock relay ES holds relay E1EF energized by its stick circuit.

It is to be noted that, during the reversal of traffic direction, the proper positioning of the contacts of the magnetic stick traffic relays F are checked in each case by the corresponding direction repeater relay BP at the adjacent approach location. In other words, the new direction repeater is energized only if the F relay at the advance location has properly positioned for the traffic reversal. This energization also checks that the approach track section is clear of any train. Each direction repeater relay must pick up and the associated F relay properly position to apply line energy to the traffic line circuit for the approach section. By way of example, during the above described traffic reversal, relay 2EBP at location 2 was energized only if relay 4F at location 4 had positioned normal for EB traffic and if the track section E1T was clear, i.e., relay 2TP picked up. Then with relay 2EBP picked up, energy is applied to line circuit 11, 12 only if relay 2F properly positions normal. Thus, if a traffic relay fails to position, no energy can be applied to the line circuit to the approach location and the cascade of traffic reversal section by section is interrupted. Also, during regular maintenance operations, if a new F relay with contacts improperly positioned is substituted into the network, traffic direction is interrupted and train movement inhibited until the relay can be repositioned. The traffic relays also determine the direction in which the track circuits feed, i.e., always toward an approaching train, which simplifies the application of cab signal energy if such train control is provided. During traffic reversal, the unoccupied condition of the track circuits is checked in accordance with the previous direction. As the section traffic line circuits are reversed in order from the new exit end, the track circuits should still register clear sections unless an apparatus fault occurs. Any such failure safely inhibits cab signal operation.

The system also provides a simplified circuit network for controlling an electric switch lock at a remote spur track within the stretch. The switch lock arrangement must provide protection for a train movement from the spur to the main track and signal indications for the entering train to move in either direction in the stretch. Thus it is necessary for the traffic circuit network to pole in both directions in the stretch. In other words, each end location must become an exit. Since one end is already an exit, the other end must reverse automatically when a switch unlock is requested and actuated.

Also the track circuits beyond the switch lock from the existing exit end must reverse so that coded track energy is fed from both ends toward the switch lock control location. As shown, the switch lock is controlled from and the track circuits divide at the intermediate location beyond the facing points of the lock switch with reference to one end location, i.e., at location 2 beyond location 3 from end location 5.

The drawings show the switch lock control network normal with westbound traffic established. That is, the switch is locked and no unlock request has been made. The switch lock WL at location 3 (FIG. 1B) is illustrated by standard symbols. In includes a magnet winding WLM which is energized by an obvious circuit controlled by front contacts b and c of a switch lock stick relay WLS. When energized, magnet WLM raises armatures such as a and b to open safety check circuits and, as indicated by the dashed line, to release mechanical locking apparatus to allow the track switch to be moved to its reverse position to enable train movements to and from the spur track. The track switch is mechanically locked against movement except when this magnet WLM is energized.

Also associated with switch lock WL, as shown by other dashed lines, are three circuit controllers CC, each illustrated at the right by a pair of contact sets shown by schematic symbols. A first circuit controller registers the condition of a derail in the spur track. Each corresponding center movable contact arm is normally closed against the associated right contact when the derail is in position to prevent a car from inadvertently fouling the main track. When the derail is moved from this position, the right contacts are opened and the here unused left contacts are closed. The center CC repeats the position of switch WL, closing the right contacts only when the switch points are lined and locked for the main track. The third CC is responsive to a padlock used to lock the switch and locking mechanism in normal position. The left contact circuits are closed as long as the padlock is in place to secure the switch. When the padlock is removed, which effectively registers a request for unlock, the right contacts are closed. It is to be noted that the movable contact arms of this pair of padlock CC contacts are connected to local source terminals B and N.

To simplify the release of the switch lock when a main line train wishes to enter or switch the spur track, a short release track circuit is provided. Its position is designated by the reference AOT and it includes the associated track relay AOTR. It may be, and is herein assumed to be, of the series overlay type and is energized only when the padlock is removed. This control is conventionally shown by a third set of padlock CC contacts inserted in the dash line associating relay AOTR with the track. Track relay AOTR thus picks up only when the track circuit AOT is occupied by the train and the padlock is removed to enable the circuit.

The principal tie in between the traffic and signal system and the switch lock WL is the WL normal repeater relay WLNWP (FIG. 1A). This biased relay is normally energized with proper polarity from source terminals B and N at location 3 over left contacts of padlock CC, normal right contacts of WL CC and derail CC, deenergized contacts a and b of magnet WLM, back contacts d and e of relay WLS, back contacts a and b of relay AOTR, and line wires 17 and 18. It is obvious that this circuit is open, and relay WLNWP released, if any portion of the switch lock apparatus is not normal or if relay AOTR picks up. A biased switch lock track repeater relay AOTP is connected in parallel with relay WLNWP, but with opposite polarity. Relay AOTP picks up only when relay AOTR picks up to reverse, at its front contacts a and b, the polarity of the energy applied from location 3 over line wires 17 and 18.

A switch lock correspondence relay WLC is normally held energized over a stick circuit including its own front contact b and front contact a of relay WLNWP. A second stick circuit includes front contact a of relay WLC and front contact c of relay AOTP. Because of the slow release characteristics of relay WLC, it will bridge, i.e., hold front contacts closed, any shift between relays WLNWP and AOTP when the polarity on lines 17 and 18 is reversed. The pick up circuit for relay WLC includes the front contact a of relay WLNWP and front contact a of track repeater relay WLTP which picks up when relay WLTR follows coded energy, under conditions to be described shortly.

A first energizing circuit for switch lock stick relay WLS from terminals B and N at location 2 includes back contacts g and h of relay WLC, front contacts f and g of both direction repeater relays 2EBP and 2WBP, front contacts e and f of relay 2TP, front contacts b and c of relay WLTP, back contacts a and b of relay AOTP, and line wires 19 and 20 to the upper winding. An alternate energizing circuit including front contacts a and b of relay AOTP and lines 19 and 20 supplies the same polarity energy. A stick circuit providing local energy over right contacts of the padlock CC and including a lower winding and front contact a of relay WLS holds the relay energized to continue an unlock condition for plural switching moves.

I shall now describe the operation as a train leaves the spur track over switch WL, with WB traffic established. When permission is given, the train crew removes the padlock. This opens the circuit for relay WLNWP which releases. This is followed by the release of relay WLC shortly after front contact a of relay WLNWP opens. Contacts e and f of relay WLC shift the connections of relay 2WBP direct to line wires 11 and 12, bypassing the rest of the local circuit network, so that this relay remains energized by the traffic line energy from end station 1. The opening of front contacts c and d of relay WLC interrupts the application of line energy eastward on lines 13 and 14. This deenergization cascades to the east end location 5. As previously described, relay 5WBP releases and, with section W5T clear, relay 5EBP is energized and picks up. Relay WF is driven normal to set up EB traffic and apply line circuit energy over front contacts a and b of relay 5EBP to lines 15 and 16. This condition cascades west and energy received at location 2 on lines 13 and 14 is applied over back contacts c and d of relay WLC direct to relay 2EBP which picks up.

With both BP relays picked up, relay 2F is deenergized but holds reverse. However, relay 2TR is now connected to the rails of section E1T over front contacts i, in series, of relays 2EBP and 2WBP and continues to receive coded track energy from contacts ECT at end location 1. Relay 2TP therefore remains energized. With back contacts h of both relay 2WBP and relay 2EBP open, transmitter contacts 2CT are disconnected from the east section rails. However, over the corresponding front contacts, switch lock track relay WLTR is connected to these rails and, with the track section yet clear, receives coded energy transmitted from location 4 under EB traffic conditions. Repeater relays WLTFP and WLTP then pick up to register the code reception. With the closing of front contacts b and c of relay WLTP, the previously traced energizing circuit for the upper winding of relay WLS at location 3 is completed and this relay picks up. This energizes the switch lock magnet WLM which picks up to release the switch WL locking mechanism. Relay WLS is held energized by its stick circuit over the right contacts of the padlock CC. The circuit for relay WLNWP is further interrupted by back contacts d and e of relay WLS and contacts a and b of magnet WLM.

It is to be noted that, if EB traffic is in effect when the switch unlock is requested, the initial conditions at location 2 find relay 2EBP picked up, relay 2WBP released, and relay 2F normal. Relay 2TR is connected to the rails east by normal contact a of relay 2F and back contact h of relay 2WBP. Contacts 2CT are connected to the rails west over normal contact b of relay 2F and back contact i of relay 2WBP. The release of relay WLC, following the release of relay WLNWP, deenergizes line circuit 11, 12 and relay 1EBP releases at location 1. This causes the station to shift to WB traffic with relay 1WBP picking up and relay EF operating reverse. Line energy is now applied to wires 11 and 12 from location 1 to energize relay 2WBP. Relay 2EBP remained energized when relay WLC released so that, with both BP relays picked up, relay 2F is deenergized but holds in its normal position. With back contacts h of both BP relays open, relay 2TR is disconnected from the east track section but the corresponding front contacts h connect relay WLTR to these rails to receive coded energy from location 4. Relays WLTFP and WLTP pick up. When back contacts i of both BP relays open, contacts 2CT are disconnected from section E1T to interrupt the transmission of coded track energy. However, front contacts i of these relays close to connect relay 2TR to these rails to receive the coded energy now being transmitted by contacts ECT. The track circuit conditions at location 2 are now the same as when the switch unlock was initiated under WB traffic conditions.

When switch WL is moved reverse, the contacts of the derail CC and WL CC further interrupt the WLNWP circuit. However, when the train occupies the main track, track circuit AOT is completed and relay AOTR picks up. This applies energy to lines 17 and 18 which will pick up relay AOTP. Although this will hold relay WLS energized (upper winding), this action is incidental to the present operation and may be intermittent. The train also shunts the section track circuit so that relay WLTR is deenergized and stays released. Its repeater relay WLTP shortly releases. With relay WLS held energized while the padlock is removed, the train may use the switch as desired.

When ready to depart, the crew restores the switch WL and derail to normal and replaces the padlock. This returns the three circuit controllers CC to the normal positions shown and relays AOTR and AOTP release. As the train moves away, relay WLTP holds open the pick up circuit for relay WLC as well as the principal circuit for relay WLS. With its stick circuit open, this latter relay releases, when relay AOTP releases, to lock up switch WL, i.e., magnet WLM is deenergized. Relay WLNWP is now reenergized with proper polarity and picks up. It is noted that, with relay WLC not reenergized, the traffic condition remains split between EB and WB at location 2.

If the train moves east from location 3, signal indications are provided to control its movement since EB traffic exists. When the train clears location 4, coded track energy is again received at location 2 to drive relay WLTR so that relay WLTP picks up. Front contact a of this latter relay closes to energize relay WLC, front contact a of relay WLNWP already being closed. Relay WLC picks up and sticks over its own front contact b. Back contact c and d of relay WLC disconnect relay 2EBP which releases. The opening of its front contact h deenergizes relay WLTR and relay WLTP releases shortly. It will be noted that the release of contact i of relay 2EBP transfers the rail connections of relay 2TR to again include reverse contact b of relay 2F which has remained closed. Relay 2WBP remains energized from the west end and, with relay 2F held reverse, terminals LB and LN are connected to line wires 13 and 14 over front contacts c and d of relay WLC. Since EB traffic is still established at location 4, line circuit energy is thus applied in bucking relationship at both ends of line circuit section 13-14.

If EB traffic is requested at the interlocking location 1, now or sometime later, the previously described actions occur. That is, relay 1WBP releases and connects relay 1EBP across line wires 11 and 12. Removal of line energy releases relay 2WBP at location 2 to interrupt the connection of terminals LB and LN to wires 13 and 14. With relay 2EBP connected to this line circuit by back contacts d and e of relay 2WBP, relay 2EBP receives the line circuit energy from location 4 and picks up. Relay 2F then shifts to its normal position to set up EB traffic. This applies line energy westward on lines 11 and 12 to establish EB traffic and authorize a train to follow through the stretch from station 1 toward station 5.

If the train entering from the spur track moves west from location 3, it also receives signals to control its movement and provide protection. When the train clears location 2, relay WLTR again responds to coded track energy from location 4, since all track circuits east from location 2 are connected to control EB traffic moves. When relay WLTP picks up, relay WLC is energized and picks up, disconnecting relay 2EBP and completing the local line circuit network to connect terminals LB, LN to wires 13 and 14. This line energy opposes that already applied at location 4. Relay 2WBP remains picked up when relay WLC, contacts e and f, shifts the westward line circuit to the normal local network since the WB traffic direction is in force to location 1.

If a request for a westward signal is now made at east end station 5, the opening of contact WFL deenergizes relay 5EBP which releases to connect relay 5 WBP across line circuit 15, 16. The concurrent removal of energy from lines 15 and 16 releases relay 4EBP, in an obvious manner, which interrupts the application of line energy to lines 13 and 14. Since section W5T is unoccupied and relay 4TP therefore picked up, release of relay 4EBP also connects relay 4WBP across the same westward line circuit pair. This relay then receives the line energy already applied at location 2 and picks up. This repositions relay 4F, which transmits line energy to location 5 to complete the shift to WB traffic. This authorizes a westward train to move through the stretch from station 5.

As previously indicated, in order for a train traveling on the main track to enter the locked spur track, the AOT track circuit is provided. Repeating, this may be a very short, overlay, series track circuit located immediately in front of the facing points of switch WL, as schematically shown. When the train completes this track circuit between the rails and the padlock is removed, relay AOTR picks up. Transfer contacts a and b of this relay pole change the line circuit 17, 18 so that relay AOTP picks up and relay WLNWP releases. As defined, relay WLC, being slow release, holds up during the shift between its two stick circuits. The traffic line circuit networks at location 2 are thus not disturbed. Front contacts a and b of relay AOTP close to energize the upper winding of relay WLS which picks up and sticks as described. Magnet WLM is energized and releases the switch lock mechanism. Even if the train moves into the clear on the spur track, the switch remains unlocked because relay WLS is held with the padlock removed. Only when the padlock is replaced and the train has cleard circuit AOT is the locking restored.

The traffic control system embodying the invention thus provides a safe yet economic circuit arrangement for controlling the movement of trains in either direction on a stretch of track. Only a two wire traffic line circuit is required, divided into sections extending between adjacent stations or locations. A single magnetic stick traffic relay is used at each location to establish and hold traffic direction. Direction register relays check the proper positioning of traffic relays and unoccupied track conditions during traffic reversal. These system checks also protect against the inadvertent substitution of an improperly positioned traffic relay during routine maintenance. The arrangement permits the use of a simple added network to control a switch lock from an existing location over a minimum number of line wires. The desired traffic control is exercised simply and safely even when a switch lock is present in the stretch.

Although only one specific form of the traffic control system embodying the invention has been shown and described, it is to be understood that various changes and modifications within the scope of the appended claims may be made without departing from the spirit and scope of the invention.

Having thus described the invention what I claim as new and desire to secure by Letters Patent, is:

1. A traffic control system for a stretch of railroad track, over which trains may move in either direction, having a first and a second end location provided with train movement request apparatus and a plurality of intermediate junction locations dividing said track stretch into sections, comprising, (a) a reversible traffic line circuit between each pair of adjacent locations, (b) a source of line circuit energy at each location, (c) a traffic control means at each location operable to a first and a second position for establishing a first or a second traffic direction, respectively, through said stretch, (d) a traffic direction registry means at each location operable to a first and a second position, (e) said traffic direction registry means at each junction location coupled to first and second line circuits extending to adjacent junction or end locations and operable to said first and second positions for registering the reception of line energy from the adjacent location in said first or second traffic direction, respectively, (f) said traffic direction registry means at each end location controlled by the corresponding movement request apparatus and coupled to the associated line circuit to the adjacent junction location for at times transmitting line energy from the associated source when that location is a traffic exit end and responsive at other times to the reception of energy from the adjacent location for establishing that location as a traffic entrance end, (g) each traffic control means controlled by the associated traffic direction registry means for operating to said first or second position as that registry means occupies its first or second position, respectively, (h) said traffic control means and said traffic direction registry means at each junction location jointly controlling the associated line circuits for transmitting energy from the associated source into the approach section line circuit for the desired traffic direction only when occupying corresponding positions, (i) transmission of line energy in the same direction through each line circuit section between said end locations holding the established traffic direction to enable movement of a train in that direction, (j) said registry means at each junction location comprises a first and a second register relay associated with a first and second line circuit terminating network, respectively, each relay energized for registering said first or second traffic direction, respectively, and both deenergized when line energy is absent from each line circuit during a traffic direction reversal, (k) said traffic control means is a magnetic stick relay, (l) a train detection track circuit means including an indication relay and a source of detection energy, reversibly coupled to the adjacent sections by first and second position contacts of said magnetic stick traffic relay, (1) said indication relay energized to register an unoccupied condition of the track section to which coupled, (m) each line circuit terminating network comprises, (1) a first circuit path including energized position contacts of one register relay and corresponding position contacts of said magnetic stick relay for connecting said line energy source to the approach line circuit for the traffic direction established by the position of said magnetic stick relay, (2) a second circuit path including energized position contacts of said track indication relay and deenergized position contacts of said one register relay for connecting the other register relay to the same line circuit to receive line energy from the adjacent location when the opposite traffic direction is being established, and (3) a third circuit path including contacts of said magnetic stick relay corresponding to the direction registered by said other register relay for bypassing said track indication relay contacts in said second circuit path when said magnetic stick relay is repositioned to establish the opposite traffic direction, and (n) the control circuit for said magnetic stick relay is controlled by contacts of said register relays for operating said magnetic stick relay to its first and second positions to establish first and second traffic directions as said first or second register relay is energized and the other deenergized, respectively.

2. A traffic control system for a stretch of railroad track, over which trains may move in either direction, having a first and a second end location provided with train movement request apparatus and a plurality of intermediate junction locations dividing said stretch into track sections, comprising, (a) a reversible traffic line circuit between each pair of adjacent locations, (b) a source of line circuit energy at each location, (c) a traffic direction registry means at each location operable to a first and a second position, (d) a traffic control means at each location controlled by the associated traffic direction registry means for operating to a first or a second position, as that registry means occupies its first or second position, respectively, for establishing a first or a second traffic direction, respectively, through said stretch, (e) a reversible train detection means for each track section, selectively coupled by the traffic control means at each end of the corresponding section for detecting the presence or absence of a train occupying that section and indicating the occupancy condition at the entrance end of the section in the established traffic direction, (f) said traffic direction registry means at each junction location coupled to the line circuits extending to each adjacent location and operable to said first and second positions for registering the reception of line energy from the adjacent location in said first or second traffic direction, respectively, (g) said traffic direction registry means at each end location controlled by the corresponding movement request apparatus and coupled to the associated line circuit to the adjacent junction location for at times transmitting line energy from the associated source when that location is a traffic exit end and responsive at other times to the reception of energy from the adjacent junction location for establishing that location as a traffic entrance end, (h) said traffic control means and said traffic direction registry means at each junction location jointly controlling the associated line circuits for transmitting energy from the associated source into the approach line circuit for the desired traffic direction only when occupying corresponding positions, (i) the direction registry means at an established exit end location being responsive to a request for an entering train movement at that end for operating to a holding condition to deenergize the adjacent line circuit to initiate a traffic direction reversal, (1) the associated traffic control means holding in its existing position, (j) the direction registry means at each junction location being responsive to the absence of line energy from the adjacent advance location for operating to the holding condition for deenergizing the approach line circuit, (k) the direction registry means at the established entrance end location being controlled by the associated train detection means and responsive to the absence of line energy on the associated line circuit for operating to its other position, if said associated train detection means indicates the adjacent track section unoccupied, for actuating the associated traffic control means to its other position to convert to an exit end location, (l) said registry and traffic control means at the new exit location jointly controlling the associated line circuit for transmitting energy from the associated line circuit source, (m) said registry means at each junction location controlled by the associated train detection means and responsive to the reception of energy over the new advance line circuit, if the associated train detection means indicates the approach section unoccupied, for completing operation to its other position to position the associated traffic control means to establish the new traffic direction, (n) said registry means and traffic control means at each junction location coupled for transmitting line energy from the associated source over the new approach line circuit only when both means are repositioned to corresponding positions for the new traffic direction, (o) the registry means at the new entrance end location being responsive to the reception of energy over the associated line circuit for completing operation to its other position to reposition the associated traffic control means to establish the new traffic direction, (p) said new entrance end traffic control means and associated registry means jointly coupled for enabling the authorization of the requested train movement when repositioned to establish the new traffic direction, and (q) transmission of line energy in the same direction through each line circuit between said end locations holding the established traffic direction to enable movement of a train in that direction.

3. A traffic control system as defined in claim 2 in which, (a) each traffic direction registry means comprises a first and a second register relay for separately registering said first and second traffic direction, respectively, when energized, (b) each traffic control means is a magnetic stick relay controlled by the associated register relays for operating to its first and second positions as said associated first or second register relay is energized and the other deenergized, respectively, (1) each traffic control relay holding in the existing traffic position when both associated register relays are deenergized, (c) said train detection means comprises a track circuit energy source and a train detector relay at each end and junction location coupled, respectively, to the approach and advance sections in the established traffic direction by the associated traffic control relay, (d) said line circuit source at each junction location is connected for transmitting line energy over the approach line circuit in the established traffic direction by energized position contacts of the corresponding register relay and contacts of the traffic control relay closed when the corresponding traffic direction is established, and (e) the new direction register relay at each junction location is initially connected during a traffic reversal to the new traffic direction advance line circuit by deenergized position contacts of the other register relay and contacts of said train detector relay closed to indicate the approach section unoccupied, (1) said train detector contacts are subsequently bypassed by contacts closed when the associated traffic control relay is repositioned to establish the new traffic direction.

4. A traffic control system as defined in claim 3 in which, (a) the second register relay at said first end location and the first register relay at said second end location are each connected to the associated line circuit by deenergized position contacts of the other register relay at the same location for receiving line energy from the adjacent junction location when the corresponding end location is the traffic entrance end, (b) the energizing circuit for the first register relay at said first end location and for the second register relay at said second end location are each controlled by the associated train movement request apparatus, and each includes a deenergized position contact of the associated other register relay and, when the associated location is an established traffic entrance end, a contact closed by the associated train detector relay when the adjacent track section is unoccupied, for energizing that register relay to enable a traffic direction reversal only in the absence of a request for an entering train movement, (1) the train detector contact being bypassed by a contact closed when the associated traffic control relay is repositioned to make that location a traffic exit end, and (c) the line circuit source at each end location is coupled to the associated line circuit at times by energized position contacts of the associated register relay registering the traffic direction for an exit end and contacts of the associated traffic control relay closed to establish the corresponding traffic direction.

5. A traffic control system as defined in claim 4; for a track stretch including switch lock apparatus associated with a track switch at a remote location within one track section, with unlocking controlled from a selected one of the adjacent junction locations; which further includes, (a) unlock means normally in a locking position and coupled when energized to release the switch lock apparatus, (b) switch detection means coupled to said lock apparatus and said switch for detecting any offnormal condition of said switch and lock apparatus and for initiating a switch unlock request, (c) a first and a second supplemental line circuit between said selected junction location and the switch and lock location, (d) a switch lock indication relay at said selected junction location, coupled by said first supplemental line circuit to said switch detection means and controlled thereby for occupying a first position to repeat a normal switch locking condition and operating to a second position to register any off-normal locking condition or the initiation of a switch unlock request, (e) a switch lock control relay coupled to be held in a first position by said indication relay in its first position and operable at times to a second position to initiate the unlocking of said switch lock apparatus when said indication relay occupies its second position, (f) said switch lock control relay coupled to the associated traffic direction register relays and to both associated traffic line circuits to adjacent junction or end locations for removing line energy from both associated traffic line circuits and directly connecting each register relay to the corresponding traffic line circuit when said control relay operates to its second position, (g) said removal of line energy establishing both end locations as exit ends from said stretch and initiating the cascaded transmission of line energy from both end locations to said selected junction location to energize both direction register relays, (h) a supplemental train detector relay at said selected junction location, (i) said direction register relays when both energized couple said supplemental train detector relay to the adjacent track section including said switch lock location and the normal train detector relay to the other adjacent track section, (j) said second supplemental line circuit controlled by said switch lock control relay, both train detector relays, and both direction register relays and coupled from a local energy source for energizing said unlock means to release said switch lock apparatus when said switch lock control relay occupies its second position, both direction register relays are energized, and each train detector relay indicates an unoccupied condition of its corresponding track section.

6. In a traffic control system for a stretch of railroad track over which trains move in either direction between first and second end stations, with intermediate junction locations dividing said stretch into sections and a reversible traffic line circuit extending between each pair of adjacent locations; at each junction location, the combination comprising, (a) a traffic control means operable between first and second positions for establishing a first or a second traffic direction, respectively, through said stretch, (b) a first and a second line circuit terminating network, each associated with a line circuit from an adjacent location in the corresponding traffic direction, (c) traffic direction registry means coupled to both said line circuit networks and responsive to the reception of line circuit energy from the first or second traffic direction for operating to a first or second position, respectively, to register the established traffic direction, (d) said registry means coupled for operating said traffic control means to its first or second position as said registry means occupies its first or second position, respectively, (e) a source of line circuit energy, (f) a train detection track circuit means selectively coupled to adjacent track sections by said traffic control means for registering the occupancy condition of the advance track section and supplying detection energy to the approach section in the established traffic direction, (g) said traffic control means and said registry means jointly controlling both line circuit networks for applying line energy from said line circuit source to the line circuit to the approach location in the established traffic direction and for receiving energy from the other line circuit, only when said traffic control means and said direction registry means occupy corresponding positions, (h) said registry means being responsive to the absence of energy in the established traffic direction advance line circuit for operating from the existing register position to an intermediate position to remove energy from the associated approach line circuit, (i) said traffic control means holding in its existing position when said registry means occupies its intermediate position, (j) said registry means coupled, in its intermediate position, to the other network, which is controlled by said train detection means, for receiving line circuit energy from the existing approach traffic line circuit only if the existing advance track section is registered unoccupied, (k) said registry means responsive to the newly received energy for operating to its other register position to shift the position of said traffic control relay to change the established traffic direction.

7. A traffic control system as defined in claim 6 in which, (a) said registry means comprises a first and a second register relay associated with said first and second line circuit terminating network, respectively, each relay energized for registering said first or second traffic direction, respectively, and both deenergized when line energy is absent from each line circuit during a traffic direction reversal, (b) said traffic control means is a magnetic stick relay, (c) said train detection track circuit means includes an indication relay and a source of detection energy, reversibly coupled to the adjacent track sections by first and second position contacts of said magnetic stick traffic relay, (1) said indication relay, when energized, registering an unoccupied condition of the track section to which coupled, (d) each line circuit terminating network comprises, (1) a first circuit path including energized position contacts of one register relay and corresponding position contacts of said magnetic stick relay for connecting said line energy source to the approach line circuit for the traffic direction established by the position of said magnetic stick relay, (2) a second circuit path including energized position contacts of said track indication relay and deenergized position contacts of said one register relay for connecting the other register relay to the same line circuit to receive line energy from the adjacent location when the opposite traffic direction is being established, and (3) a third circuit path including contacts of said magnetic stick relay corresponding to the direction registered by said other register relay for bypassing said track indication relay contacts in said second circuit path when said magnetic stick relay is repositioned to establish the opposite traffic direction, and which also includes, (e) a control circuit for said magnetic stick relay controlled by contacts of said register relays for operating said magnetic stick relay to its first and second positions to establish first and second traffic directions as said first or second register relay is energized and the other deenergized, respectively.

8. A traffic control system as defined in claim 7 for a stretch of track including a remotely controlled switch lock apparatus located within one track section, and in which said combination at one adjacent junction location further includes, (a) a switch lock indication relay coupled for registering the switch lock apparatus condition, normally occupying a first position indicating said switch lock is fully locked and operating to a second position when any element of said switch lock apparatus is not in normal lock condition or when an unlock request is initiated, (b) a switch lock control relay controlled in part by said switch lock indication relay to normally occupy a first position and operated to a second position to enable an unlock of said switch lock apparatus when said lock indication relay occupies its second position, (c) each line circuit network includes first position contacts of said switch lock control relay for connecting said first, second, and third circuit paths to the corresponding line circuit to an adjacent location and for interrupting said paths if a switch unlock is requested, (1) interruption of the first circuit path deenergizing the approach line circuit in the established traffic direction to initiate a traffic reversal between said one adjacent junction location and the existing entrance end location, (d) each line circuit network further includes a fourth circuit path completed by second position contacts of said lock control relay for connecting the associated direction register relay direct to the corresponding line circuit when a switch unlock is requested, (e) supplemental train detection means coupled to the rails of the adjacent section which includes the switch lock, by energized position contacts in series of both direction register relays for indicating the occupancy condition of that corresponding track section, (1) said normal train detection means is coupled to the rails of the other adjacent section by other energized position contacts in series of both direction register relays for indicating the occupancy condition of that section, and (f) a control circuit network for said switch lock apparatus, including second position contacts of said switch lock control relay, energized position contacts of both direction register relays, contacts closed by said supplemental train detection means when said adjacent switch lock section is unoccupied, and contacts closed by the normal train detection means when said other adjacent section is unoccupied, and coupled for unlocking said switch lock apparatus when traffic is established away from said one junction location to both end locations and both adjacent track sections are unoccupied by a train.

* * * * *